US012780525B2

(12) United States Patent
Kang et al.

(10) Patent No.: US 12,780,525 B2
(45) Date of Patent: Nov. 3, 2026

(54) PANEL TRAY AND METHOD OF PACKAGING PANEL

(71) Applicant: Samsung Display Co., LTD., Yongin-si (KR)

(72) Inventors: Min Yeob Kang, Cheonan-si (KR); Ja Huem Koo, Seoul (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 19/052,511

(22) Filed: Feb. 13, 2025

(65) Prior Publication Data

US 2025/0178814 A1 Jun. 5, 2025

Related U.S. Application Data

(62) Division of application No. 17/741,415, filed on May 10, 2022, now Pat. No. 12,234,077.

(30) Foreign Application Priority Data

Aug. 17, 2021 (KR) ..... 10-2021-0108014

(51) Int. Cl.
*B65D 1/00* (2006.01)
*B65D 1/34* (2006.01)
(Continued)

(52) U.S. Cl.
CPC ..... *B65D 81/054* (2013.01); *B65D 1/34* (2013.01); *B65D 79/02* (2013.01); *B65D 2203/12* (2013.01); *B65D 2581/051* (2013.01)

(58) Field of Classification Search
CPC ..... B65D 81/051; B65D 2581/051; B65D 81/056; B65D 81/054; B65D 81/057;
(Continued)

(56) References Cited

U.S. PATENT DOCUMENTS 5,339,958 A 8/1994 Taravella et al.
6,874,629 B1 * 4/2005 Wortrich ..... A61B 17/3217 206/349

(Continued)

FOREIGN PATENT DOCUMENTS

CN 111071597 4/2020
JP 2002037380 A 2/2002

(Continued)

*Primary Examiner* — Jacob A Smith
(74) *Attorney, Agent, or Firm* — CANTOR COLBURN LLP

(57) ABSTRACT

A panel tray includes: a main body part including outer walls extending in a first direction and a second direction intersecting the first direction and defining a space on a lower surface thereof, a plurality of slots disposed respectively at corners where one sidewall of the outer walls extending in the first direction and another sidewall of the outer walls extending in the second direction meet each other, where the slots include a plurality of guide parts. Each of the guide parts includes a first guide part extending in the first direction, and a second guide part intersecting the first guide part and extending in the second direction, and each of the slots includes an alignment mark defined on an upper surface of one of the first guide part and the second guide part.

10 Claims, 18 Drawing Sheets

(51) Int. Cl.
*B65D 79/02* (2006.01)
*B65D 81/05* (2006.01)

(58) Field of Classification Search
CPC ..... B65D 81/113; B65D 81/05; B65D 1/34; B65D 79/02; B65D 2203/12
USPC ..... 206/453, 586, 521; 53/473
See application file for complete search history.

(56) References Cited

U.S. PATENT DOCUMENTS

| | | | | |
|---|---|---|---|---|
| 7,931,143 | B1 | 4/2011 | Lin | |
| 10,457,464 | B2 * | 10/2019 | Lv | B65D 81/107 |
| 10,906,718 | B2 | 2/2021 | Sim et al. | |
| 2004/0129589 | A1 | 7/2004 | Tucker et al. | |
| 2013/0156537 | A1 | 6/2013 | Lo et al. | |
| 2014/0138377 | A1 * | 5/2014 | Kuo | B65D 85/48 220/4.28 |
| 2014/0262927 | A1 | 9/2014 | Guo et al. | |
| 2014/0340610 | A1 | 11/2014 | Hu | |
| 2016/0001964 | A1 | 1/2016 | Yue et al. | |
| 2016/0272411 | A1 * | 9/2016 | Cheng | B65D 85/48 |
| 2019/0300261 | A1 * | 10/2019 | Nakamichi | B65D 85/30 |
| 2020/0071052 | A1 * | 3/2020 | Cheng | B65D 81/054 |
| 2020/0172315 | A1 | 6/2020 | Hu | |
| 2020/0189825 | A1 | 6/2020 | Nakamichi | |

FOREIGN PATENT DOCUMENTS

| | | | |
|---|---|---|---|
| JP | 2003234399 | | 8/2003 |
| KR | 100812766 | B1 | 3/2008 |
| KR | 1020100129921 | A | 12/2010 |
| KR | 1020110070547 | | 6/2011 |
| KR | 1020170004931 | A | 1/2017 |
| KR | 1020200037910 | | 4/2020 |
| KR | 1020200044262 | | 4/2020 |
| KR | 1020200138513 | A | 12/2020 |

* cited by examiner

PANEL TRAY AND METHOD OF PACKAGING PANEL

This application is a divisional of U.S. patent application Ser. No. 17/741,415, filed on May 10, 2022, which claims priority to Korean Patent Application No. 10-2021-0108014, filed on Aug. 17, 2021, and all the benefits accruing therefrom under 35 U.S.C. 119, the content of which in its entirety is herein incorporated by reference.

BACKGROUND

1. Field

The disclosure relates to a panel tray and a method of packaging a panel.

2. Description of the Related Art

The importance of display devices has increased with the development of multimedia. Accordingly, various types of display device such as an organic light emitting display ("OLED") and a liquid crystal display ("LCD") are widely used in various fields.

A display device may be a self-light emitting display device including a light emitting element as a device for displaying an image. The self-light emitting display device includes a light emitting element, and may be an organic light emitting display device using an organic material as a light emitting material, an inorganic light emitting display device using an inorganic material as a light emitting material, or the like.

SUMMARY

Various types of display devices used in mobile devices have been developed to have a smaller thickness, and a method of preventing damage to the display device due to an external impact during transport and storage of the display device has been desired. In particular, a case where the display device is damaged due to collision with a tray storing the display device in a process of packaging the display device in the tray may occur. Therefore, it is desired to safely package the display device from a packaging step before a transport process.

Embodiments of the disclosure provide a panel tray capable of safely storing a panel such as a display device.

Embodiments of the disclosure also provide a method of packaging a panel capable of safely packaging a panel such as a display device using the panel tray.

According to an embodiment of the disclosure, a panel tray includes: a main body part including a plurality of outer walls extending in a first direction and a second direction intersecting the first direction, where a space is defined on an inner surface of the main body part by the outer walls, a plurality of slots disposed respectively at corners where one sidewall of the outer walls extending in the first direction and another sidewall of the outer walls extending in the second direction meet each other, where the slots include a plurality of guide parts. In such an embodiment, each of the guide parts includes a first guide part extending in the first direction, and a second guide part intersecting the first guide part and extending in the second direction, and each of the slots includes an alignment mark defined on an upper surface of one of the first guide part and the second guide part.

In an embodiment, each of the alignment marks may be defined on a same guide part among the first guide part and the second guide part of each of.

In an embodiment, the alignment mark may be defined by an engraved pattern in which a portion of the upper surface of the one of the first guide part and the second guide part is recessed.

In an embodiment, the alignment mark may include ink filling the engraved pattern, and the ink has a color different from a color of the upper surface of the one of the first guide part and the second guide part.

In an embodiment, each of the slot may include polyurethane.

In an embodiment, each of the slot may include about 30 parts by weight to about 45 parts by weight of fibers based on 100 parts by weight of the polyurethane, and a portion of the upper surface of the one of the first guide part and the second guide part except for a region in which the alignment mark is defined may have a surface roughness greater than a surface roughness of an upper surface of the alignment mark.

In an embodiment, a maximum width of the alignment mark may be in a range of about 3 millimeters (mm) to about 6 mm.

In an embodiment, each of the slot may include a first fastening part extending in an opposite direction to the first guide part, a second fastening part extending in a direction intersecting the first fastening part, a first cushion part disposed on a lower surface of the first guide part, and a second cushion part disposed on a lower surface of the second guide part.

In an embodiment, The main body part may include a plurality of support parts disposed at lower portions of the corners where the slots are disposed and a plurality of groove parts defined at the corners of the outer walls and defined by recessed portions of the outer walls, and the slots may be disposed respectively on the support parts such that the first fastening parts and the second fastening parts are inserted into the groove parts different from each other.

In an embodiment, the main body part may include a plurality of protrusion parts protruded inwardly from a sidewall of the outer walls extending in the second direction.

According to an embodiment of the disclosure, a method of packaging a panel includes: preparing a panel tray including a main body part including a plurality of outer walls defining a space in which the panel is mounted and a plurality of slots disposed respectively at corners of the main body part, where the slots include a plurality of alignment marks defined on upper surfaces thereof, aligning a panel on the panel tray, and seating the panel in the space of the main body part. In such an embodiment, each of the slots includes a first guide part parallel to one sidewall of the outer walls extending in one direction and a second guide part parallel to another sidewall of the outer walls extending in another direction intersecting the one direction, and the alignment mark is defined on an upper surface of one of the first guide part and the second guide part.

In an embodiment, the aligning the panel on the panel tray may include: recognizing positions of the alignment marks of the panel tray, and recognizing a plurality of alignment patterns defined on the panel and aligning the panel tray and the panel with each other based on the positions of the alignment marks.

In an embodiment, each of the alignment marks may be defined on a same guide part among the first guide part and the second guide part of each of the slots.

In an embodiment, an interval between a side of the panel and a corresponding one of the alignment marks may be in a range of about 4 mm to about 8 mm when the panel is seated in the space of the main body part.

In an embodiment, the panel may be disposed in a region defined by the first guide part and the second guide part of each of the slots.

In an embodiment, a side of the panel may be spaced apart from and face the first guide part and the second guide part of a corresponding one of the slots.

In an embodiment, the main body part may include a plurality of groove parts defined at the corners of the outer walls and defined by recessed portions of the outer walls, and the slot may include a first fastening part extending in an opposite direction to the first guide part and inserted into a first groove part of the groove parts and a second fastening part extending in a direction intersecting the first fastening part and inserted into a second groove part of the groove parts intersecting the first groove part.

In an embodiment, the alignment mark may be defined by an engraved pattern in which a portion of the upper surface of the one of the first guide part and the second guide part is recessed, each of the alignment marks may further include ink filling the engraved pattern, and the ink may have a color different from a color of the upper surface of the one of the first guide part and the second guide part.

In an embodiment, each of the slots may include about 30 parts by weight to about 45 parts by weight of fibers based on 100 parts by weight of polyurethane, and a portion of the upper surface of the one of the first guide part and the second guide part except for a region in which the alignment marks are formed may have a rough surface.

In an embodiment, a maximum width of the alignment mark may be in a range of about 3 mm to about 6 mm.

In embodiments, the panel tray includes the plurality of slots disposed at the corners of the main body part. The alignment marks may be formed respectively in the slots to prevent damage to the panel due to misalignment between the panel and the panel tray when the panel is mounted in the panel tray.

BRIEF DESCRIPTION OF THE DRAWINGS

The above and other features of the disclosure will become more apparent by describing in detail embodiments thereof with reference to the attached drawings, in which.

DETAILED DESCRIPTION

Figure 1:
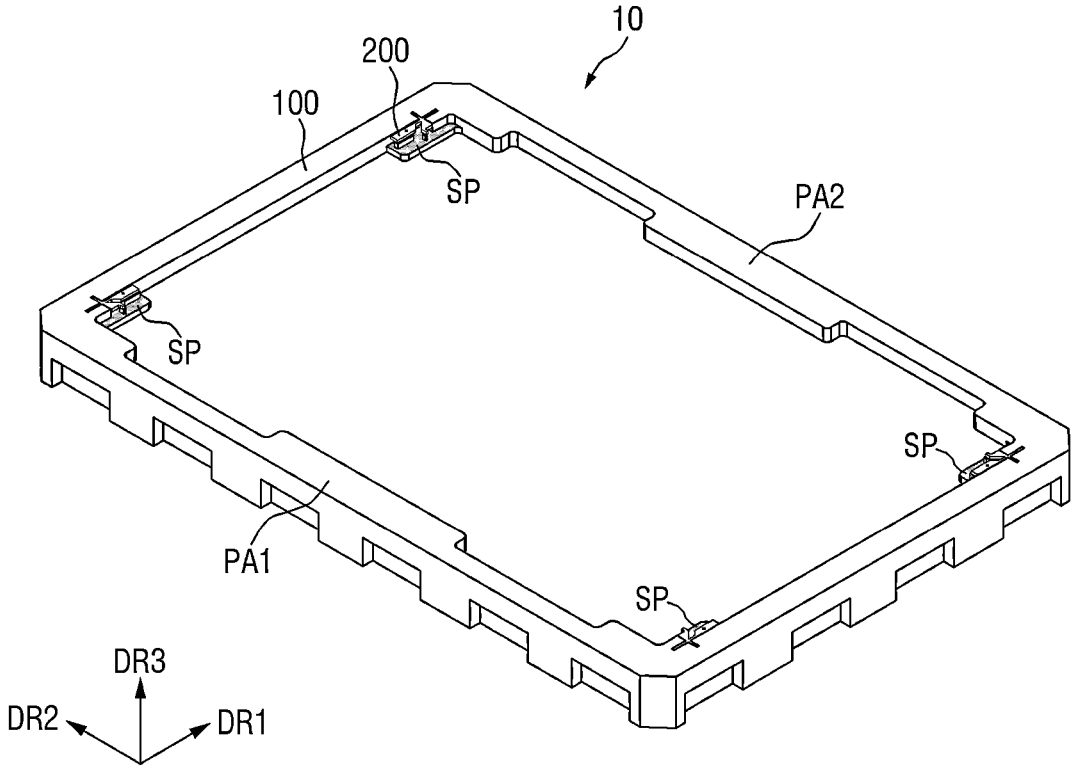
FIG. 1 is a perspective view illustrating a panel tray according to an embodiment.

The invention will now be described more fully hereinafter with reference to the accompanying drawings, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art.

It will also be understood that when a layer is referred to as being "on" another layer or substrate, it can be directly on the other layer or substrate, or intervening layers may be present therebetween. In contrast, when an element is referred to as being "directly on" another element, there are no intervening elements present. The same reference numbers indicate the same components throughout the specification.

It will be understood that, although the terms "first," "second," etc. may be used herein to describe various elements, these elements should not be limited by these terms. These terms are only used to distinguish one element from another element. For instance, a first element discussed below could be termed a second element without departing from the teachings of the invention. Similarly, the second element could also be termed the first element.

The terminology used herein is for the purpose of describing particular embodiments only and is not intended to be limiting. As used herein, "a", "an," "the," and "at least one" do not denote a limitation of quantity, and are intended to include both the singular and plural, unless the context clearly indicates otherwise. For example, "an element" has the same meaning as "at least one element," unless the context clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10% or 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, embodiments of the invention will be described with reference to the accompanying drawings.

Figure 2:
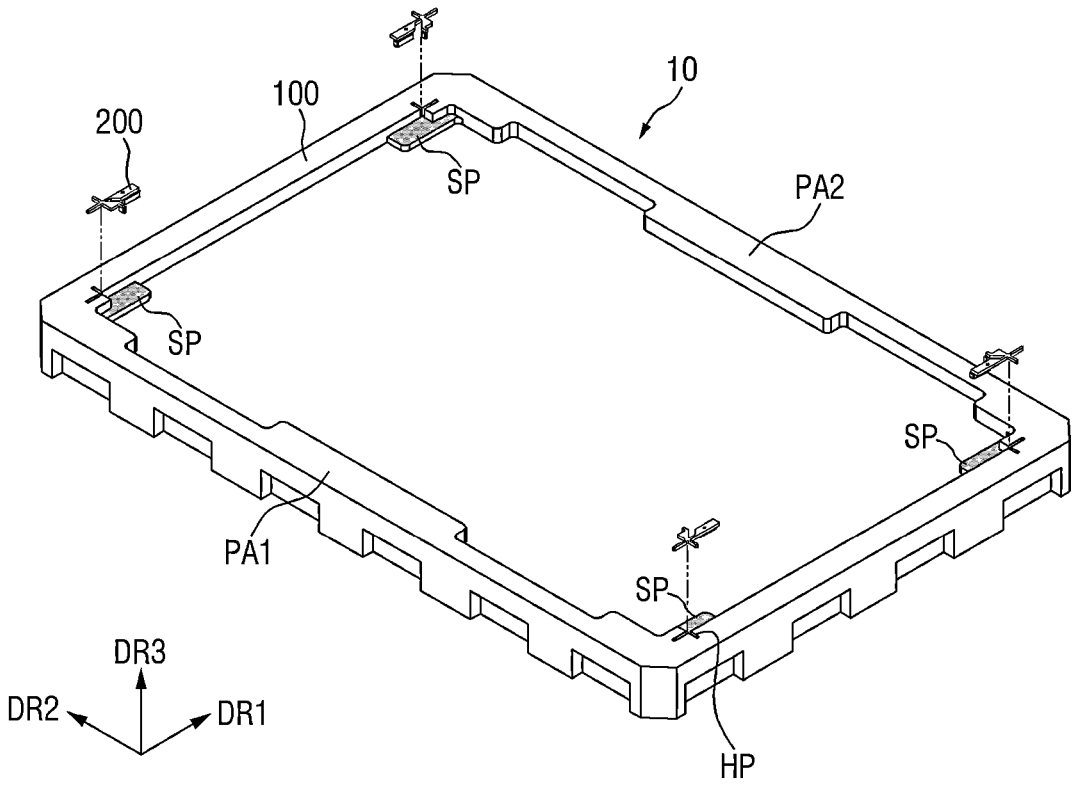
FIG. 2 is an exploded perspective view illustrating a plurality of slots separated from the panel tray of FIG. 1.
Figure 3:
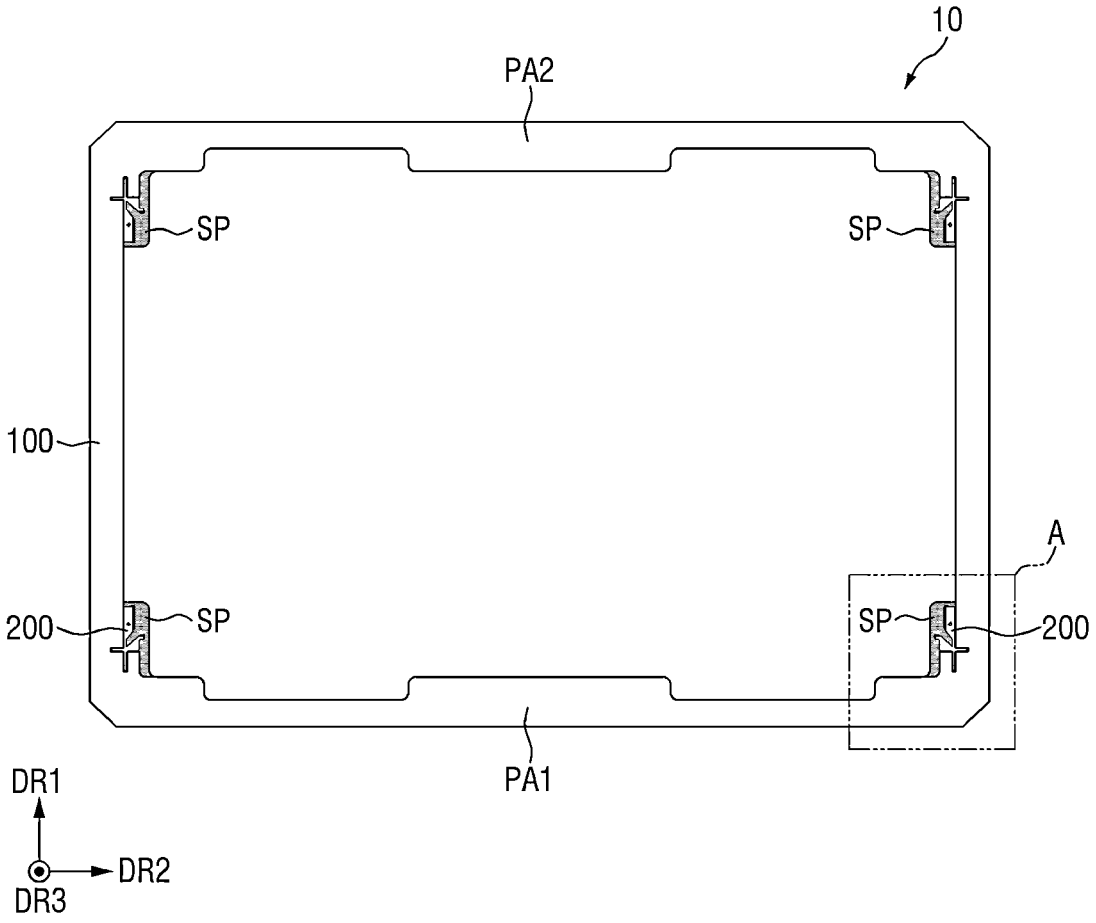
FIG. 3 is a plan view of the panel tray of FIG. 1.

FIG. 1 is a perspective view illustrating a panel tray according to an embodiment. FIG. 2 is an exploded perspective view illustrating a plurality of slots separated from the panel tray of FIG. 1. FIG. 3 is a plan view of the panel tray of FIG. 1.

The terms "left", "right", "upper", and "lower" as used herein refer to directions when the drawings are viewed in a plan view. For example, "upper" refers to a first direction DR1, "lower" refers to an opposite direction to the first direction DR1, "right" refers to a second direction DR2, and "left" refers to an opposite direction to the second direction DR2. In addition, "above", "top", and "upper surface" refer to a third direction DR3, and "below", "bottom", and "lower surface" refer to an opposite direction to the third direction DR3.

Referring to FIGS. 1 to 3, an embodiment of a panel tray 10 includes a main body part 100 and a plurality of slots 200. In such an embodiment of the panel tray 10, panels 1000 (see FIG. 10) may be disposed in the main body part 100, and the slots 200 may be positioned to face sides of the panels 1000 disposed in the main body part 100. The slots 200 may guide the panels 1000 so that the panels 1000 are stably packaged or mounted in the panel tray 10 or may prevent portions of the panels 1000 from being damaged by an external impact.

The main body part 100 may have a rectangular shape in a plan view. In an embodiment, for example, as illustrated in FIG. 1, a lower surface of the main body part 100 may have a rectangular shape, in a plan view, having short sides in the first direction DR1 and long sides in the second direction DR2. A corner where the short side in the first direction DR1 and the long side in the second direction DR2 meet may be right-angled or may have a predetermined curvature. The shape of the main body part 100 in a plan view is not limited to the rectangular shape, and may be other polygonal shapes, a circular shape, or an elliptical shape. In such an embodiment, the main body part 100 may have one of various shapes corresponding to a shape of the panel 1000 mounted therein.

The main body part 100 includes outer walls disposed on sides of a bottom surface thereof. The outer walls of the main body part 100 may surround a space in which the panels 1000 are mounted. The outer walls of the main body part 100 have a predetermined height and thickness. The height and thickness of the outer walls of the main body part 100 may vary based on the number of panels 1000 stored in the panel tray 10. The outer walls of the main body part 100 may have a height enough to prevent the panel 1000 from being separated from the panel tray 10 when the panel 1000 is mounted and transported or stored in the panel tray 10. In an embodiment, the outer walls of the main body part 100 may have a height greater than at least a thickness of the panel 1000.

FIGS. 1 to 3 illustrate an embodiment in which corners where the outer walls meet have an angular shape, but the disclosure is not limited thereto, and alternatively, the corners may have a rounded shape. In an embodiment, each outer wall may have a curved shape in which a region extending in one direction is partially recessed. However, the disclosure is not limited thereto.

According to an embodiment, the main body part 100 of the panel tray 10 may include a plurality of protrusion parts PA1 and PA2 formed or defined on the outer walls. The outer walls of the main body part 100 may have outer surfaces that are flat or partially curved, and some of the outer walls of the main body part 100 may include the protrusion parts PA1 and PA2 partially protruded from inner surfaces thereof defining a space in which the panel 1000 is mounted. In an embodiment, for example, the main body part 100 may include first and second protrusion parts PA1 and PA2 formed or defined, respectively, on upper and lower outer walls, which are outer walls extending in the second direction DR2, among the outer walls. The first protrusion part PA1 may be formed on an inner surface of the lower outer wall among the outer walls of the main body part 100, and the second protrusion part PA2 may be formed on an inner surface of the upper outer wall among the outer walls of the main body part 100. In such an embodiment, left and right outer walls among the outer walls of the main body part 100 may have inner surfaces that are relatively flat. The outer walls of the main body part 100 include the protrusion parts PA1 and PA2 that are partially formed, and thus, have a thickness varying depending on a position. Portions of the outer walls where the protrusion parts PA1 and PA2 are formed may have a width greater than that of other portions.

The protrusion parts PA1 and PA2 of the main body part 100 may form or define a space in which an external device connected to the panel 1000 is positioned when the panel 1000 is mounted in the panel tray 10. The panel 1000 has a shape substantially similar to the shape of the panel tray 10 in a plan view, and may include external devices disposed on one side thereof. The protrusion parts PA1 and PA2 of the main body part 100 may be formed to correspond to structures and layouts of the external devices of the panel 1000, and may prevent the external devices from being in contact with and damaged by the main body part 100. FIGS. 1 to 3 illustrate an embodiment where the first protrusion part PA1 and the second protrusion part PA2 are positioned, respectively, at central portions of the upper and lower outer walls among the outer walls of the main body part 100. However, the disclosure is not limited thereto, and alternatively, positions of the first protrusion part PA1 and the second protrusion part PA2 may vary based on a structure of the panel 1000 mounted in the panel tray 10.

In an embodiment, the main body part 100 may include a plurality of support parts SP and a plurality of groove parts HP (HP1 and HP2 in FIG. 4) disposed, respectively, at corners where the respective outer walls extending in the first direction DR1 and the second direction DR2 meet. When the panels 1000 are mounted in the panel tray 10, corner portions of the panels 1000 may be disposed on the support parts SP of the main body part 100. The support part SP may have a height lower than the outer wall of the main body part 100, and may be disposed inside the outer wall. In an embodiment, for example, the main body part 100 of the panel tray 10 may have the rectangular shape in a plan view, and include four support parts SP disposed adjacent to respective corners thereof. The corner portions of the panel 1000 may be disposed on the support parts SP, respectively, and in an embodiment, upper surfaces of the support parts SP may be coated with protective members. The upper surfaces of the support parts SP may be coated with the protective members or protective layers may be disposed on the upper surfaces of the support parts SP, so that the panel 1000 is not damaged even though the panel 1000 is in direct contact with the support parts SP.

The support parts SP may have a shape extending in one direction, and may be disposed on the bottom surface of the main body part 100 on which the panels 1000 are mounted. The support parts SP may have a shape of which a length in the first direction DR1 is greater than a length in the second direction DR2, and may be disposed inside outer walls extending in the first direction DR1 among the outer walls of the main body part 100. However, the disclosure is not limited thereto, and a layout and a shape of the support part SP may be variously modified.

The groove parts HP (HP1 and HP2 in FIG. 4) of the main body part 100 may be disposed at portions of the outer walls adjacent to the corners. First groove parts HP1 having a shape extending in the second direction DR2 may be formed or defined in the outer walls extending in the first direction DR1 among the outer walls of the main body part 100, and second groove parts HP2 having a shape extending in the first direction DR1 may be formed or defined in the outer walls extending in the second direction DR2 among the outer walls of the main body part 100. The first groove part HP1 and the second groove part HP2 may be formed in each corner portion of the main body part 100 while forming a pair. In an embodiment in which the main body part 100 has the rectangular shape in a plan view, a pair of groove parts HP1 and HP2 are formed at each corner of the main body part 100, such that four first groove parts HP1 and four second groove parts HP2 may be formed. One outer wall may be connected to the other outer walls at both corners, and the groove parts HP1 and HP2 may be formed in each of portions adjacent to both corners of each outer wall. In an embodiment, for example, two groove parts HP1 and HP2 may be formed in the outer wall extending in one direction.

Each of the first and second groove parts HP1 and HP2 may have a predetermined depth and have a shape recessed from a sidewall of the outer wall. The first groove part HP1 and the second groove part HP2 may extend in the second direction DR2 and the first direction DR1, respectively, and may meet at a point where the first groove part HP1 and the second groove part HP2 intersect each other. Portions where the first and second groove part HP1 and HP2 are formed may be substantially the same as positions where the support parts SP are disposed. In an embodiment, for example, the first and second groove parts HP1 and HP2 may be formed at portions of the outer walls where the support parts SP are disposed.

The plurality of slots 200 may be disposed at the corners of the main body part 100, respectively. The slots 200 include portions that may be inserted into the groove parts HP1 and HP2 formed at the corners of the main body part 100, such that portions of the slots 200 may be disposed in the groove parts HP1 and HP2 and the other portions of the slots 200 may be disposed on the supporting parts SP on which the panel 1000 is disposed.

Figure 4:
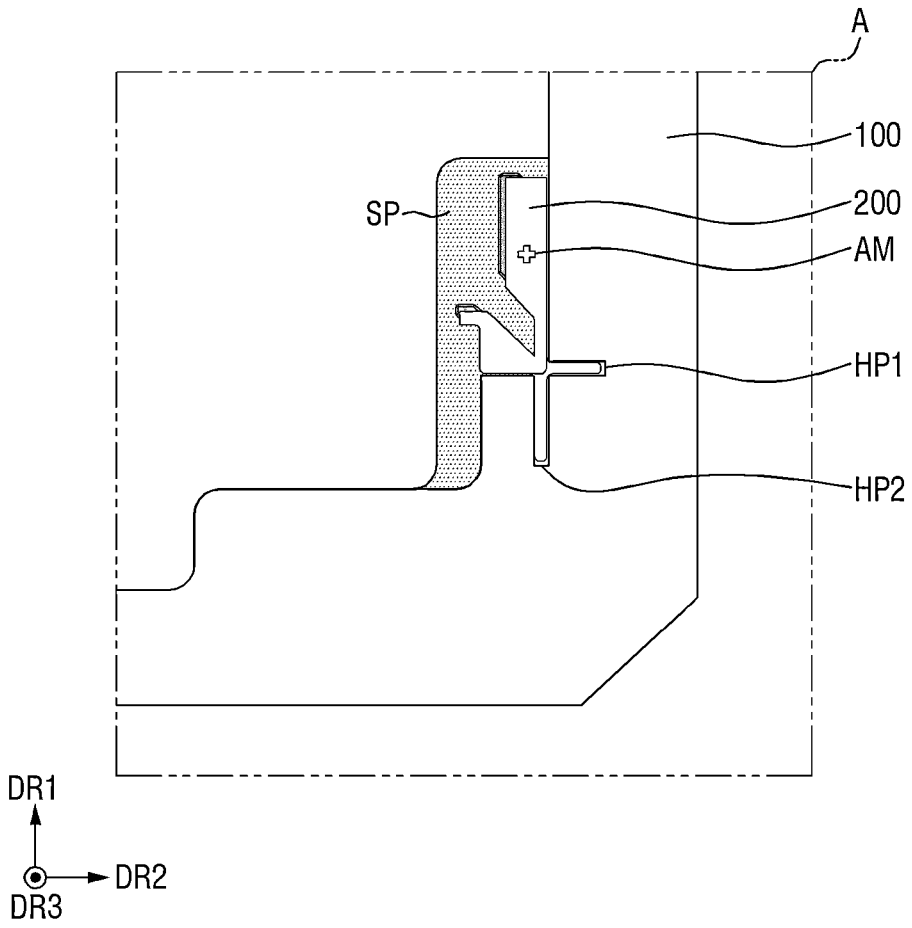
FIG. 4 is an enlarged view of part A of FIG. 3.
Figure 5:
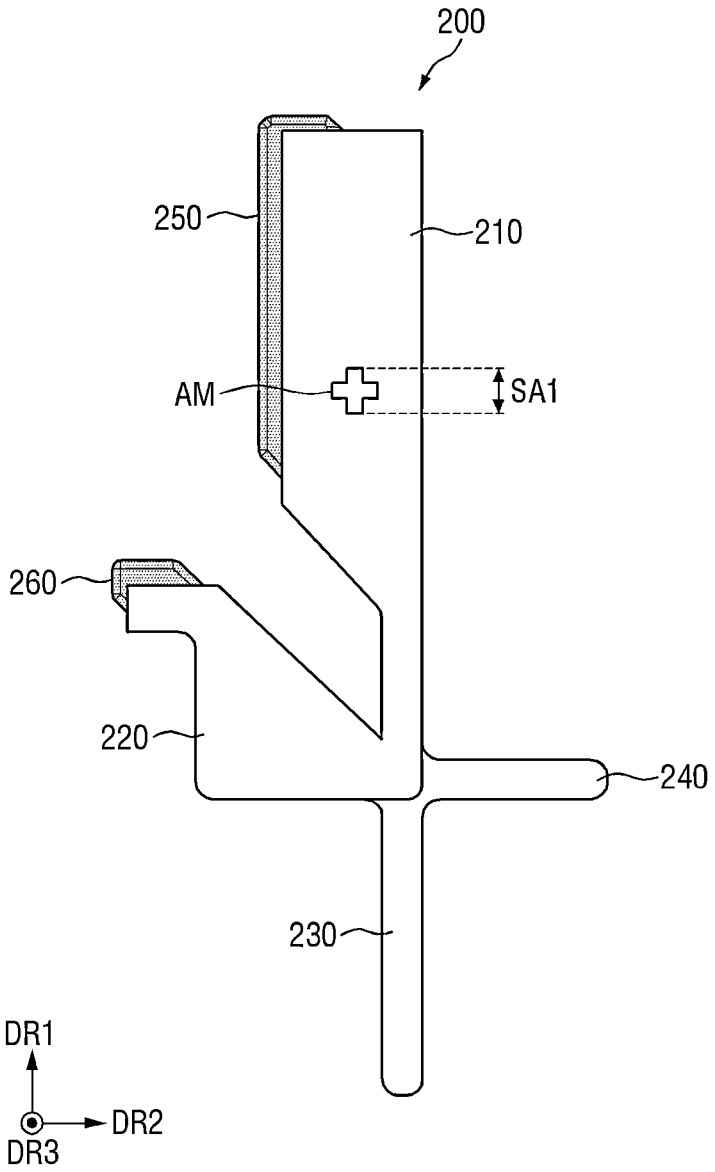
FIG. 5 is a plan view illustrating a slot of the panel tray according to an embodiment.

FIG. 4 is an enlarged view of part A of FIG. 3. FIG. 5 is a plan view illustrating a slot of the panel tray according to an embodiment. FIG. 4 is an enlarged view of the slot 200 disposed at one of a plurality of corners of the main body part 100.

Referring to FIGS. 4 and 5 in conjunction with FIGS. 1 to 3, the panel tray 10 may include a plurality of slots 200 disposed at corners, respectively. As described above, in an embodiment in which the main body part 100 of the panel tray 10 has the rectangular shape in a plan view, the panel tray 10 may include four slots 200 disposed respectively at four corners. Each slot 200 may be inserted into the groove parts HP1 and HP2 formed at the corner of the main body part 100 and be disposed on the support part SP. The slot 200 may prevent the panel 1000 from being damaged by an external impact when the panel 1000 is seated in the main body part 100.

In an embodiment, as shown in FIG. 5, the slot 200 may include a plurality of guide parts 210 and 220, a plurality of fastening parts 230 and 240, and a plurality of cushion parts 250 and 260. The slot 200 may be disposed at the corner where the outer walls of the main body part 100 extending in the first direction DR1 and the second direction DR2 intersect each other, and may thus have a structure corresponding to a shape of the corner. The slot 200 may include a pair of guide parts 210 and 220, fastening parts 230 and 240, and cushion parts 250 and 260 extending in the first direction DR1 and the second direction DR2.

In an embodiment, for example, the slot 200 may include a first guide part 210 extending in the first direction DR1 and a second guide part 220 having a predetermined width from one side of the first guide part 210 toward the second direction DR2. A first fastening part 230 extending in the first direction DR1 and a second fastening part 240 extending in the second direction DR2 may be disposed at a portion where the first guide part 210 and the second guide part 220 intersect each other. In such an embodiment, the slot 200 may include a first cushion part 250 and a second cushion part 260 positioned on an opposite side to the portion where the first guide part 210 and the second guide part 220 intersect each other. Hereinafter, the portion where the first guide part 210 and the second guide part 220 intersect each other and a portion where the first fastening part 230 and the second fastening part 240 intersect each other will be referred to as a 'central portion of the slot 200'

The first guide part 210 may have a shape extending from the central portion of the slot 200 substantially in the first direction DR1. The first guide part 210 may have different widths at a portion thereof adjacent to the central portion of the slot 200 and a portion thereof where the first cushion part 250 is disposed. The first guide part 210 may be disposed to be in contact with an inner sidewall of the outer wall extending in the first direction DR1 among the outer walls of the main body part 100, and may face a side extending in the first direction DR1 among sides of the panel 1000.

The second guide part 220 may have a shape extending from the central portion of the slot 200 substantially in the second direction DR2. The second guide part 220 may have a shape in which a length thereof in the second direction DR2 may be smaller than that of the first guide part 210, but a maximum width thereof measured in the first direction DR1 is greater than a maximum width of the first guide part 210 measured in the second direction DR2. The second guide part 220 may also have different widths at a portion thereof adjacent to the central portion of the slot 200 and a portion thereof where the second cushion part 260 is disposed. The second guide part 220 may have a shape in which one side opposite to the central portion of the slot 200 partially protrudes. A protruding end portion of the second guide part 220 may guide a region in which the panel 1000 is mounted, and as described later, the second cushion part 260 may be disposed at the protruding end portion of the second guide part 220. The second guide part 220 may be disposed to be in contact with an inner sidewall of the outer wall extending in the second direction DR2 among the outer walls of the main body part 100, and may face a side extending in the second direction DR2 among the sides of the panel 1000.

The first guide part 210 and the second guide part 220 may limit or minimize movement of the panel 1000 when the panel 1000 is mounted in the panel tray 10. Each of the slots 200 disposed at the corners of the main body part 100 may be disposed so that the guide parts 210 and 220 face the panel 1000 inside the outer walls of the main body part 100. The panel tray 10 may be configured in a way such that a space thereof in which the panel 1000 is mounted is greater than that of the panel 1000. In the panel tray 10, an area, in a plan view, of a space surrounded by the main body part 100 may be greater than an area of the panel 1000 in a plan view. Even though the panel 1000 mounted in the main body part 100 moves during transport, the movement of the panel 1000 may be minimized by the guide parts 210 and 220.

In an embodiment, the slot 200 may include the cushion parts 250 and 260 disposed on lower surfaces of the guide parts 210 and 220 to decrease an external impact applied to the panel 1000. The first cushion part 250 may be disposed on the lower surface of the first guide part 210, and the second cushion part 260 may be disposed on the lower surface of the second guide part 220. The first cushion part 250 and the second cushion part 260 may be disposed, respectively, below one sides of the first guide part 210 and the second guide part 220 facing a space surrounded by the outer walls of the main body part 100. In a plan view, the first cushion part 250 and the second cushion part 260 may be disposed to protrude from the one sides of the first guide part 210 and the second guide part 220, respectively. When the panel 1000 moves in the panel tray 10, the sides of the panel 1000 may be in contact with the cushion parts 250 and 260 of the slot 200, and an external impact applied to the panel 1000 may be decreased by the cushion parts 250 and 260. In an embodiment, the cushion parts 250 and 260 may include or be made of a polymer material having a low hardness. In an embodiment, the slot 200 may include or be made of a material having a relatively low hardness. In an embodiment, each of the guide parts 210 and 220 and the fastening parts 230 and 240 of the slot 200 may include or be made of a polymer material such as polyurethane.

The first fastening part 230 may have a shape extending from the central portion of the slot 200 in the first direction DR1. The first fastening part 230 may extend in an opposite direction to the first guide part 210 with respect to the central portion of the slot 200. The first fastening part 230 may have a width smaller than that of the first guide part 210, and may have a shape corresponding to the second groove part HP2 of the main body part 100. The second fastening part 240 may have a shape extending from the central portion of the slot 200 in the second direction DR2. The second fastening part 240 may extend in an opposite direction to the second guide part 220 with respect to the central portion of the slot 200. The second fastening part 240 may have a width smaller than that of the second guide part 220, and may have a shape corresponding to the first groove part HP1 of the main body part 100. The slot 200 may be disposed so that the first fastening part 230 and the second fastening part 240 are inserted into the groove part HP1 and HP2 of the main body part 100, respectively, and be thus fixed to the main body part 100. In an embodiment, for example, a width of each of the fastening parts 230 and 240 may be the same as or smaller than that of each of the groove parts HP1 and HP2 of the main body part 100.

When the panel 1000 is mounted in the panel tray 10, the panel 1000 may be mounted in the panel tray 10 to be positioned in a space formed or defined by the guide parts 210 and 220 of the slot 200. In such an embodiment, as described above, the main body part 100 of the panel tray 10 may have the area greater than that of the panel 1000 in a plan view, and the slots 200 forming the space in which the panel 1000 is mounted are disposed at the corners of the main body part 100, respectively, to decrease a difference between the area of the main body part 100 and the area of the panel 1000. The panel 1000 may be mounted in a space substantially formed by imaginary lines extending from the first guide parts 210 and the second guide parts 220 of the slots 200 in the first and second directions DR1 and DR2, respectively.

In a process of mounting or packaging the panel 1000, it is desired to position the panel 1000 in an imaginary space formed by the guide parts 210 and 220 of the slots 200. When the panel 1000 is placed on the panel tray 10 in a state in which the panel 1000 is not positioned in the imaginary space, there is a possibility that the panel 1000 will be damaged while directly colliding with the main body part 100 or the slots 200. That is, it may be desired that the panel 1000 is accurately aligned in the space formed by the guide parts 210 and 220 of the slots 200 while the main body part 100 and the panel 1000 are aligned with each other side by side in the process of mounting or packaging the panel 1000.

According to an embodiment, the slot 200 of the panel tray 10 may include an alignment mark AM formed (or defined) on the guide part 210 or 220 as a display part or pattern for alignment of the panel 1000 in the process of packaging the panel 1000. In a process of mounting the panel 1000 in the main body part 100, the panel 1000 may be aligned with the panel tray 10 based on the alignment marks AM defined or formed in the slots 200. Since the panel tray 10 aligns the panel 1000 using the alignment marks AM formed in the slots 200 rather than portions where the slots 200 are disposed in the process of packaging the panel 1000, misalignment between the panel 1000 and the panel tray 10 may be decreased, and damage to the panel 1000 may be effectively prevented.

The alignment mark AM of the slot 200 may be formed on an upper surface of either the first guide part 210 or the second guide part 220. In an embodiment, as illustrated in FIGS. 4 and 5, the alignment mark AM of each slot 200 may be formed on the upper surface of the first guide part 210 and may not be formed on the upper surface of the second guide part 220. Different slots 200 disposed in the main body part 100 may include alignment marks AM formed at a same position, respectively. In an embodiment in which any one slot 200 includes the alignment mark AM formed on the upper surface of the first guide part 210, for example, the other slots 200 of the panel tray 10 may also include the alignment marks AM formed on the upper surfaces of the first guide parts 210, respectively. In an embodiment, when any one slot 200 includes the alignment mark AM formed on the upper surface of the second guide part 220, the other slots 200 may also include the alignment marks AM formed on the second guide parts 220, respectively. In the panel tray 10, the respective slots 200 disposed at the corners may have a same shape and structure as each other.

According to an embodiment, each of the plurality of slots 200 of the panel tray 10 may include only as single alignment mark AM. In a case where different alignment marks AM are formed in one slot 200, when the panel tray 10 and the panel 1000 are aligned with each other based on the alignment marks AM formed at different positions in the slots 200 positioned at each corner, the panel 1000 and the panel tray 10 may not be normally aligned with each other. In an embodiment, only a single alignment mark AM may be formed in each slot 200, and a position of the alignment mark AM may be the same for each slot 200 to prevent such misalignment.

In an embodiment, the alignment mark AM may be formed on the upper surface of any one of the guide parts 210 and 220, and may not be formed at the portion where the guide parts 210 and 220 intersect each other or the portion where the fastening parts 230 and 240 intersect each other. The alignment mark AM formed at the portion where the guide parts 210 and 220 intersect each other or the portion where the fastening parts 230 and 240 intersect each other, which is the central portion of the slot 200, is highly likely to be misrecognized by distal end portions of the surrounding guide parts 210 and 220 and fastening parts 230 and 240. In an embodiment of the panel tray 10, the alignment mark AM may be formed on the upper surface of the guide part 210 or 220 of the slot 200 to prevent misalignment when the panel 1000 and the panel tray 10 are aligned with each other.

The alignment mark AM may have a shape that may be easily recognized by a camera device to be used when the panel 1000 and the panel tray 10 are aligned with each other. A maximum width SA1 of the alignment mark AM measured in the first direction DR1 or the second direction DR2 may be about 10 mm or less or about 5 mm or less. In an embodiment, for example, the alignment mark AM may have a size in a range of about 1 mm to about 6 mm, for example, a size of about 3 mm. In an embodiment, as illustrated in FIGS. 4 and 5, the alignment mark AM may have a '+' shape, but is not limited thereto. In an alternative embodiment, the alignment mark AM may have a polygonal shape, a circular shape, or other shapes distinguishable from other parts of the slot 200.

Figure 6:
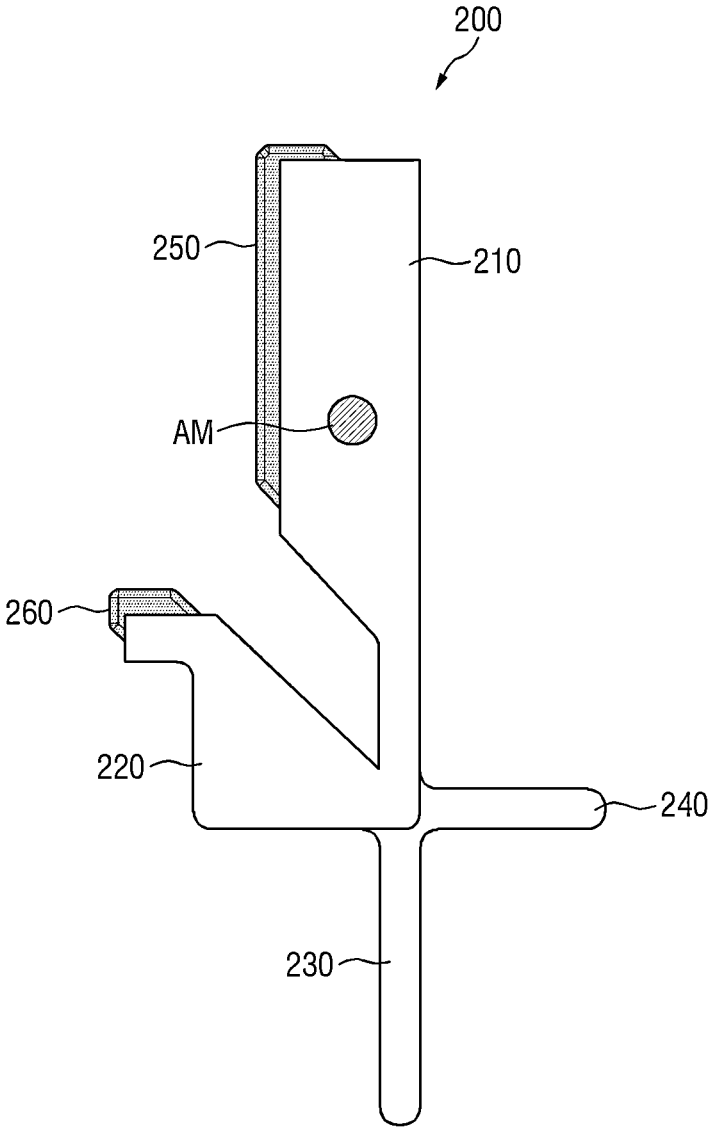
FIG. 6 is a plan view illustrating a slot of a panel tray according to an alternative embodiment.

FIG. 6 is a plan view illustrating a slot of a panel tray according to an alternative embodiment.

Referring to FIG. 6, in an embodiment of a panel tray 10, an alignment mark AM formed in a slot 200 may have a circular shape in a plan view. The slot 200 may have a shape in which a first guide part 210 and a second guide part 220, and a first fastening part 230 and a second fastening part 240 extend in the first direction DR1 and the second direction DR2 and intersect each other. The shape of the alignment mark AM that may be easily recognized by the camera device may be a shape distinguished from other parts of the slot 200. According to an embodiment, the alignment mark AM may be effectively recognized by the camera device and may further decrease the misalignment between the panel 1000 and the panel tray 10 by having a shape different from other parts of the slot 200, for example, the guide parts 210 and 220 and the fastening parts 230 and 240.

Alternatively, in some embodiments, a structure of the alignment mark AM of the slot 200 may be changed or an upper surface of the slot 200 may be surface-treated so that the alignment mark AM may be easily recognized by the camera device.

Figure 7:
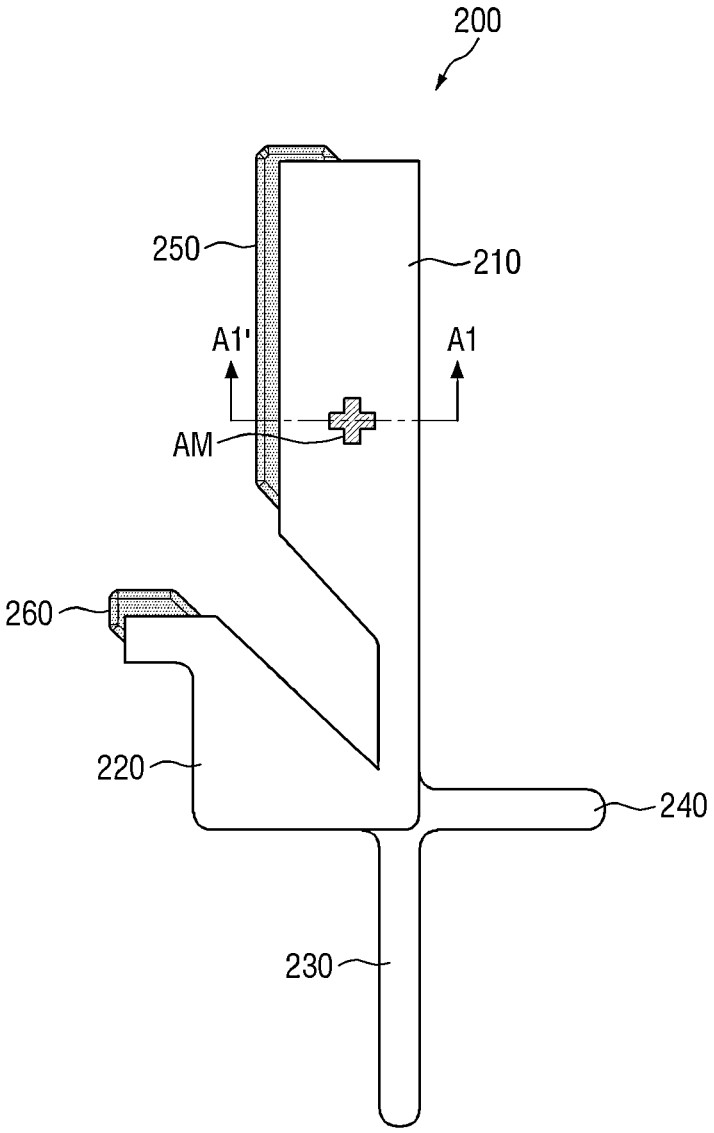
FIG. 7 is a plan view illustrating a slot of a panel tray according to another alternative embodiment.
Figure 8:
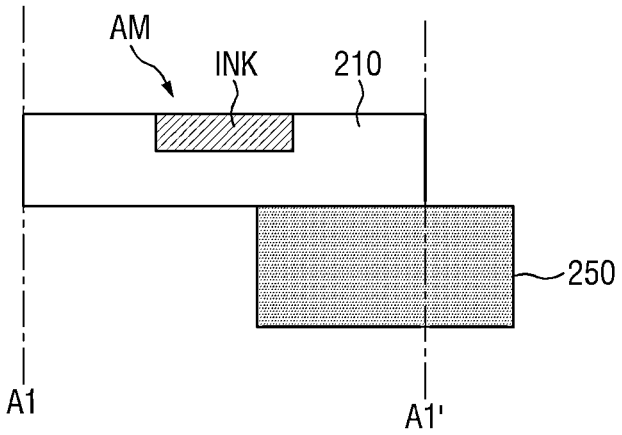
FIG. 8 is a cross-sectional view taken along line A1-A1' of FIG. 7.

FIG. 7 is a plan view illustrating a slot of a panel tray according to another alternative embodiment. FIG. 8 is a cross-sectional view taken along line A1-A1' of FIG. 7. FIG. 8 illustrates a cross-section crossing a portion in which an alignment mark AM is formed in the slot 200 of FIG. 7.

Referring to 7 and 8, in an embodiment, the slot 200 may include an alignment mark AM having a structure in which a portion of an upper surface of the guide part 210 or 220 is recessed. The alignment mark AM may have a shape of an engraved pattern, and the recessed portion of the upper surface may be filled with ink INK so that the alignment mark AM is clearly visually recognized differently from the surrounding. The alignment mark AM of the slot 200 formed in or defined by the engraved pattern may be filled with ink INK having a color different from a surface color of the guide parts 210 and 220 of the slot 200, and the camera device may easily recognize the alignment mark AM in a process of aligning the panel 1000 and the panel tray 10.

Alternatively, the slot 200 may have a rough surface in a region other than the alignment mark AM so that the alignment mark AM may be easily recognized.

Figure 9:
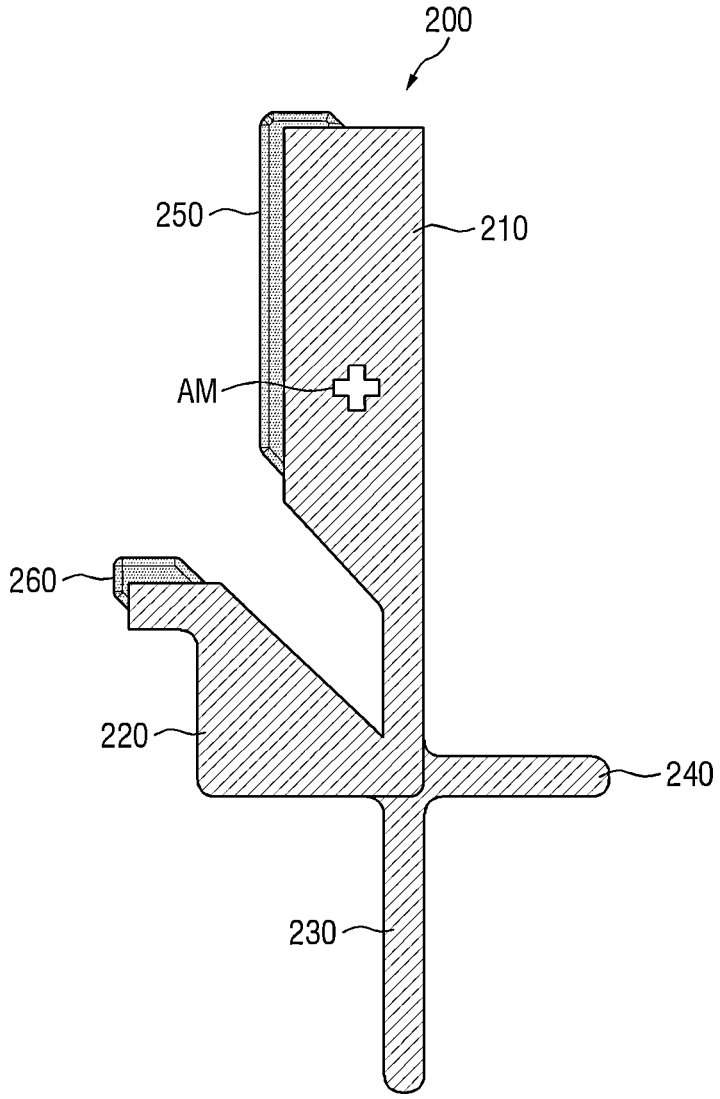
FIG. 9 is a plan view illustrating a slot of a panel tray according to another alternative embodiment.

FIG. 9 is a plan view illustrating a slot of a panel tray according to another alternative embodiment.

Referring to FIG. 9, in an embodiment of a panel tray 10, a region of an upper surface of a slot 200 except for a region in which an alignment mark AM is formed or defined may have a surface roughness greater than that of the alignment mark AM. In the slot 200, an upper surface of each of guide parts 210 and 220, and fastening parts 230 and 240 may be relatively rough, and the alignment mark AM may have a relatively smooth shape. In an embodiment, the guide parts 210 and 220 and the fastening parts 230 and 240 of the slot 200 may include or be made of a material such as polyurethane, and may include or be made of polyurethane containing fiber. In an embodiment, for example, the guide parts 210 and 220 and the fastening parts 230 and 240 of the slot 200 may include about 20 parts by weight to about 50 parts by weight or about 30 parts by weight to about 45 parts by weight of fiber, based on 100 parts by weight of polyurethane. Accordingly, the guide parts 210 and 220 and the fastening parts 230 and 240 may have a rough surface due to the fiber as compared with an embodiment in which the guide parts 210 and 220 and the fastening parts 230 and 240 include or are made of only polyurethane.

The alignment mark AM may be formed on an upper surface of any one of the guide parts 210 and 220 to have a smooth surface or may have a shape of an engraved pattern or a structure in which the engraved pattern is filled with ink INK as in an embodiment of FIG. 7. Unlike the guide parts 210 and 220 and the fastening parts 230 and 240, the alignment mark AM has a smooth surface rather than a rough surface, and may thus be relatively easily recognized as compared with a region other than the alignment mark AM.

Figure 10:
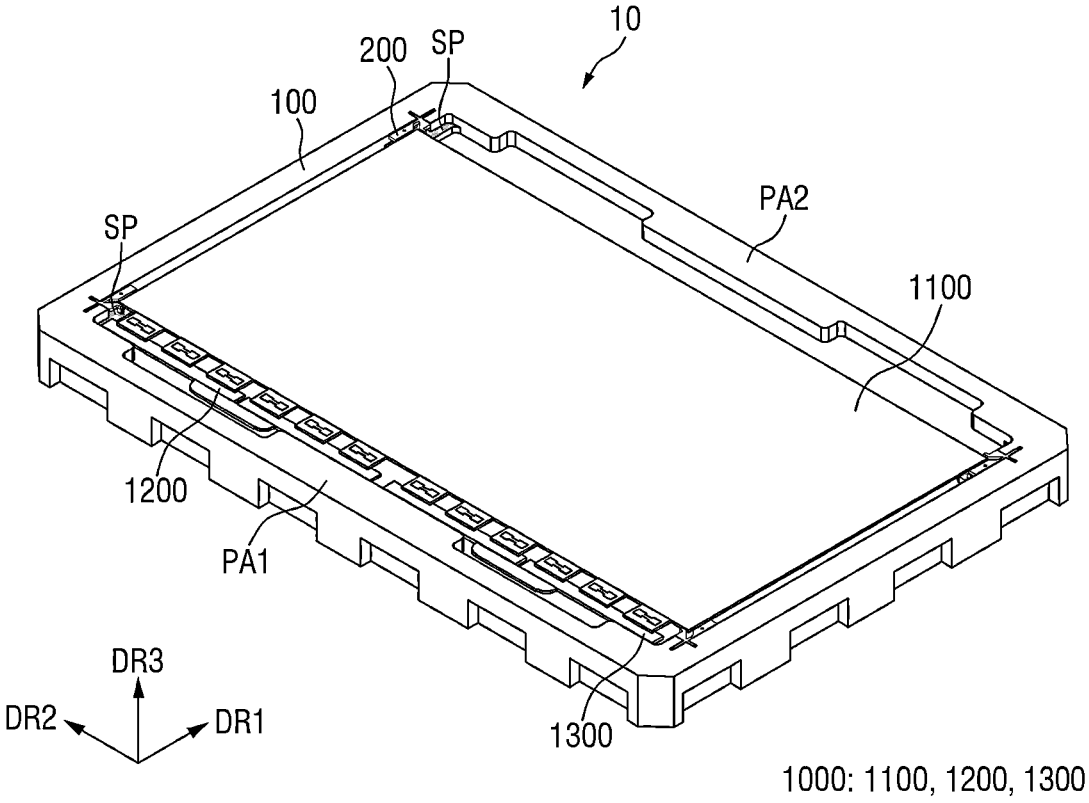
FIG. 10 is a perspective view illustrating a state in which a panel is packaged in the panel tray according to an embodiment.
Figure 11:
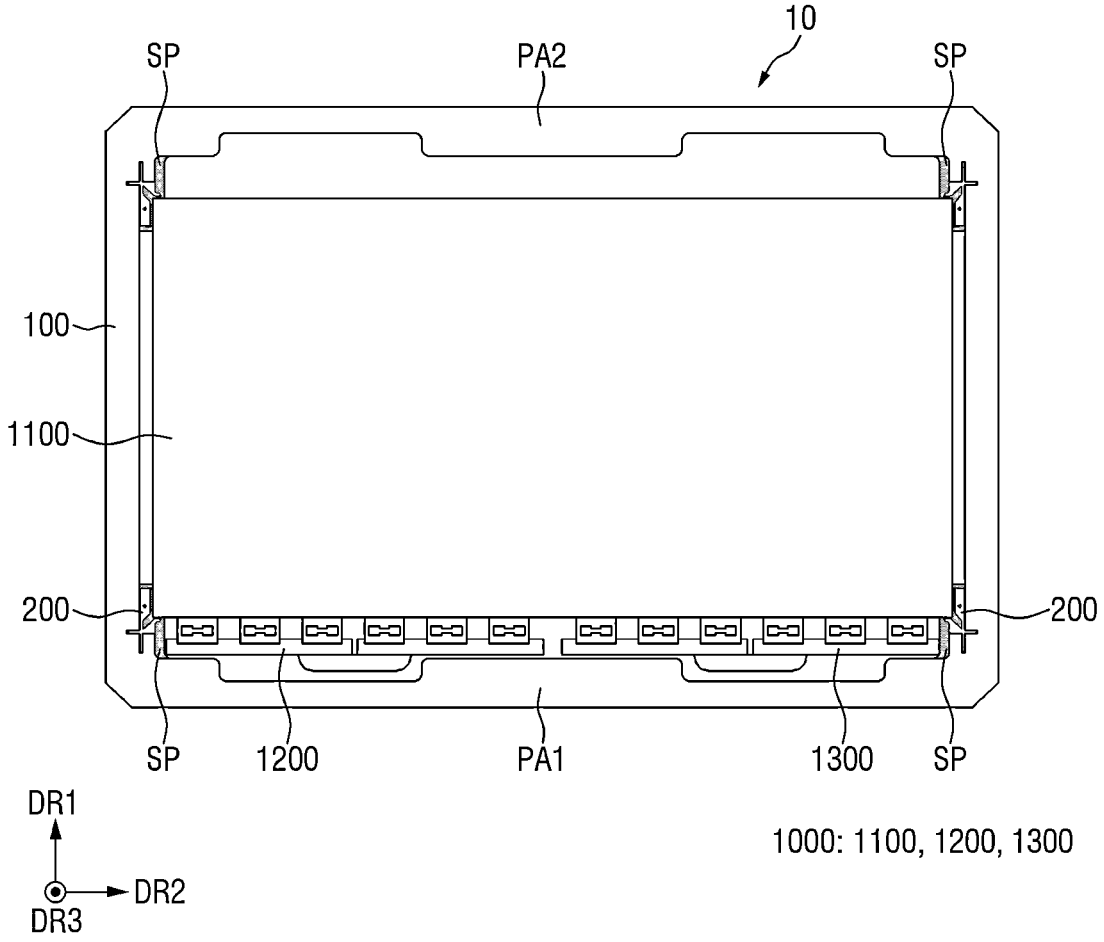
FIG. 11 is a plan view illustrating the state in which the panel is packaged in the panel tray according to an embodiment.

FIG. 10 is a perspective view illustrating a state in which a panel is packaged in the panel tray according to an embodiment. FIG. 11 is a plan view illustrating the state in which the panel is packaged in the panel tray according to an embodiment.

Referring to FIGS. 10 and 11, a panel 1000 may be mounted in the main body part 100 of the panel tray 10 according to an embodiment. The panel 1000 may include a display panel 1100 having a shape including sides extending in the first direction DR1 and the second direction DR2, and external devices 1200 and 1300 disposed on one side of the display panel 1100.

In an embodiment, the panel 1000 may include the display panel 1100 including a display screen. In an embodiment, the display panel 1100 may include an inorganic light emitting diode display panel, an organic light emitting display panel, a quantum dot light emitting display panel, a plasma display panel, a field emission display panel, or the like. Hereinafter, an embodiment where the display panel is an inorganic light emitting diode display panel will be described, but the disclosure is not limited thereto.

A shape of the display panel 1100 may be variously modified. In an embodiment, for example, the display panel 1100 may have a shape such as a rectangular shape with a width greater than a length, a rectangular shape with a length greater than a width, a square shape, a quadrangular shape with rounded corners (vertices), other polygonal shapes, or a circular shape. n FIGS. 10 and 11 illustrate an embodiment where the display panel 1100 has a rectangular shape with a greater length in the second direction DR2.

The external devices 1200 and 1300 in which components capable of providing the display screen on the display panel 1100 are disposed may be disposed on one side of the display panel 1100. The external devices 1200 and 1300 may be disposed on a lower side of sides of the display panel 1100 extending in the second direction DR2. FIGS. 10 and 11 illustrate an embodiment including a first external device 1200 and a second external device 1300 spaced apart from each other are disposed, but the disclosure is not limited thereto.

The panel 1000 mounted in the panel tray 10 may be seated in a region surrounded by the outer walls of the main body part 100. Each of sides of the display panel 1100 in the panel 1000 may be disposed to face the outer walls of the main body part 100 and the guide parts 210 and 220 of the slots 200. In an embodiment, corner portions where extending sides of the display panel 1100 meet may face the slots 200, respectively. The first guide part 210 of the slot 200 may face a side of the display panel 1100 extending in the first direction DR1, and the second guide part 220 of the slot 200 may face a side of the display panel 1100 extending in the second direction DR2. In an embodiment, as described above, the corners of the display panel 1100 may be seated on the support parts SP disposed at the corners of the main body part 100.

The display panel 1100 may include elements for providing the display screen which may be vulnerable to an external impact. In an embodiment of the panel tray 10, the slots 200 disposed at the corners of the main body part 100 may be disposed to face the sides of the display panel 1100, respectively, to fix the panel 1000 so that the panel 1000 hardly moves in the panel tray 10. Even though the panel 1000 moves by an external impact, the cushion parts 250 and 260 of the slots 200 may be in contact with the sides of the display panel 1100, and the external impact may be almost absorbed. Accordingly, the panel tray 10 may prevent the panel 1000 from being damaged.

In an embodiment, the main body part 100 of the panel tray 10 may have a structure corresponding to a shape of the panel 1000 by including the protrusion parts PA1 and PA2 formed on some of the outer walls. Since the panel 1000 includes the external devices 1200 and 1300 disposed on one side of the display panel 1100 extending in the second direction DR2, a space in which the external devices 1200 and 1300 may be disposed is desired to be secured. The external devices 1200 and 1300 may be disposed on a lower side of the display panel 1100 as illustrated in FIGS. 10 and 11 or may be disposed in spaces formed by the first protrusion part PA1. When portions of the display panel 1100 on which the external devices 1200 and 1300 are disposed are disposed to face an upper side of the panel tray 10, the external devices 1200 and 1300 of the panel 1000 may be disposed in spaces formed by the second protrusion PA2. In an embodiment, the panel tray 10 may include the plurality of slots 200 disposed at each corner to safely store the panels 1000 so that the panels 1000 are not damaged. In an embodiment, in a process of packaging or mounting the panels 1000 in the panel tray 10, the panel 1000 and the panel tray 10 are aligned with each other based on the alignment marks AM formed or defined in the slot 200, and thus, damage to the panel 1000 due to misalignment between the panel 1000 and the panel tray 10 may be effectively prevented.

Hereinafter, an embodiment of a method of packaging a panel using the panel tray 10 will be described in detail.

Figure 12:
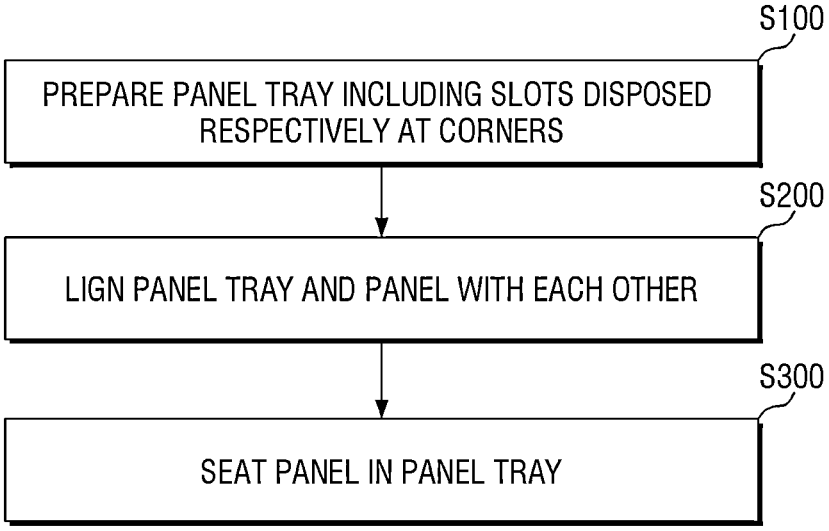
FIG. 12 is a flowchart illustrating a method of packaging a panel according to an embodiment.

FIG. 12 is a flowchart illustrating a method of packaging a panel according to an embodiment.

Referring to FIG. 12, an embodiment of the method of packaging a panel may include preparing a panel tray 10 including a plurality of slots 200 disposed at corners (S100), aligning the panel tray 10 and a panel 1000 with each other (S200), and seating the panel 1000 in the panel tray 10 (S300). The panel tray 10 may be the panel tray 10 described above with reference to FIGS. 1 to 11. The panel tray 10 may include the plurality of slots 200 disposed at each corner, and each of the slots 200 may include an alignment mark AM formed on an upper surface of any one of guide parts 210 and 220. In the aligning of the panel tray 10 and the panel 1000 with each other, positions of the alignment marks AM formed on the slots 200 of the panel tray 10 are recognized and the panel 1000 and the panel tray 10 are then aligned with each other, and thus, misalignment between the panel tray 10 and the panel 1000 may be effectively prevented.

FIGS. 13 to 17 are views sequentially illustrating the method of packaging a panel according to an embodiment.

Figure 13:
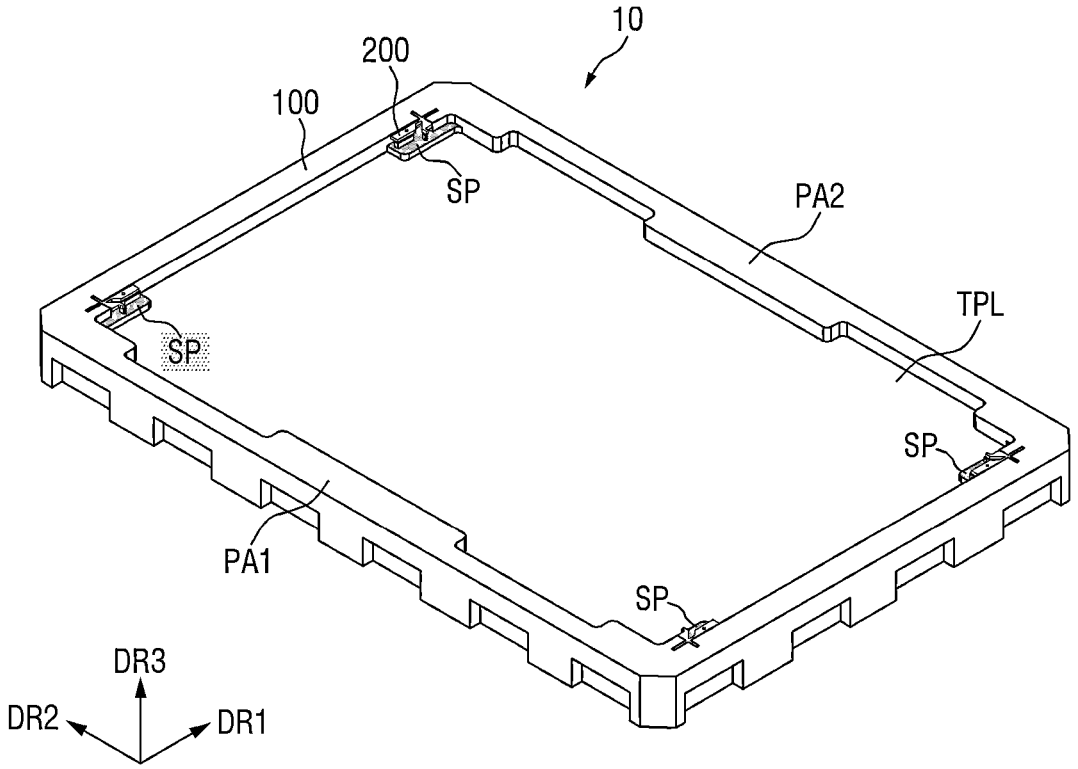
FIGS. 13 to 17 are views sequentially illustrating the method of packaging a panel according to an embodiment.

First, referring to FIG. 13, the panel tray 10 including the plurality of slots 200 disposed at each corner is prepared (S100 in FIG. 12). The panel tray 10 includes a main body part 100 having outer walls surrounding an accommodation part in which the panel 1000 is mounted, and the plurality of slots 200 disposed respectively at corners of the main body part 100. In such an embodiment, the main body part and the slots are the same as those described above. In each of the plurality of slots 200 of the panel tray 10, guide parts on which alignment marks AM are formed, of the first guide parts 210 and the second guide parts 220, may be the same as each other.

According to an embodiment, the panel tray 10 may further include a protective film TPL disposed on an inner bottom surface of the main body part 100. The protective film TPL may prevent damage to the panel 1000 that may occur due direct contact between the panel 1000 mounted in the panel tray 10 and the main body part 100. Alternatively, the protective film TPL may be omitted.

Figure 14:
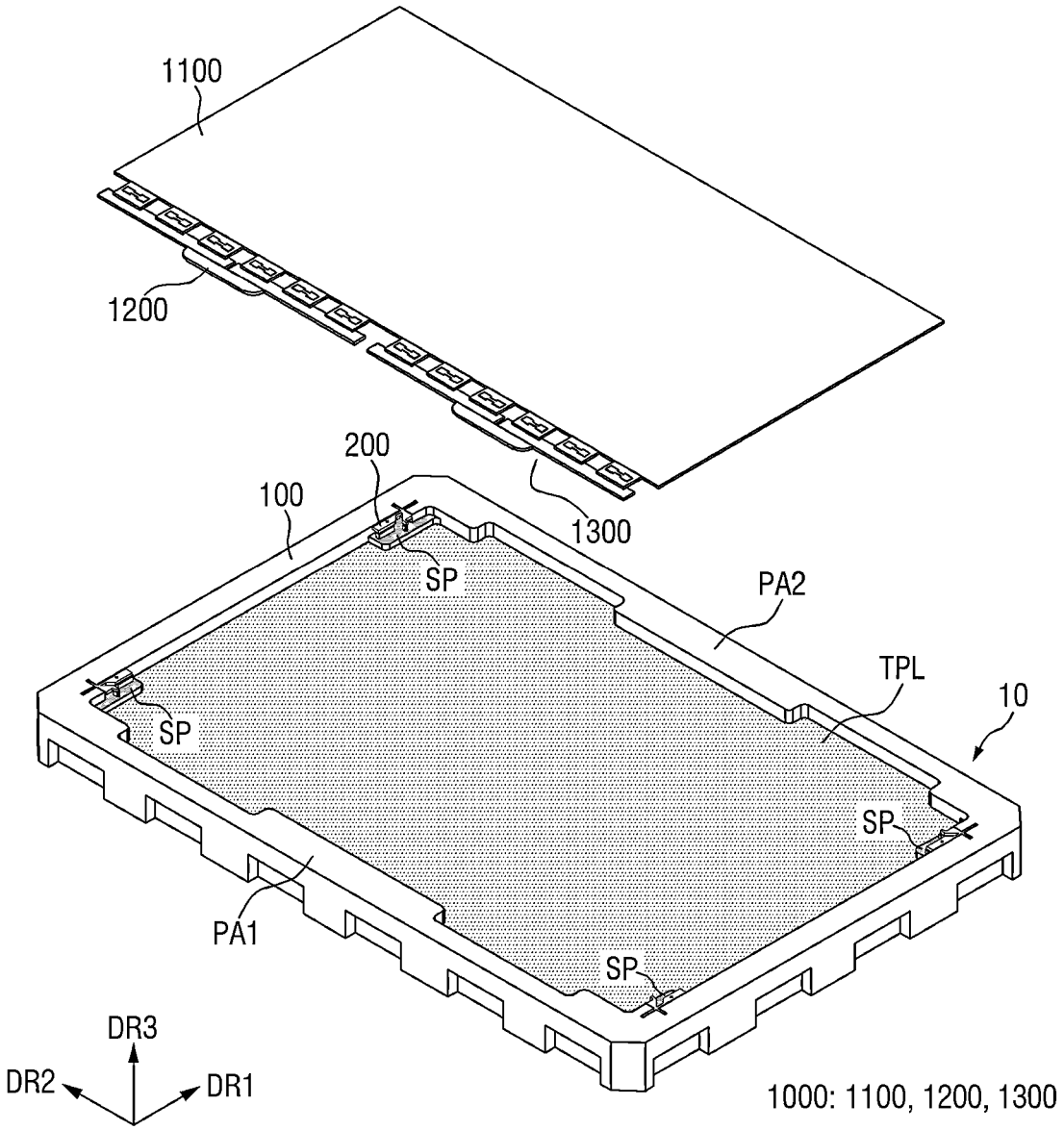
Figure 15:
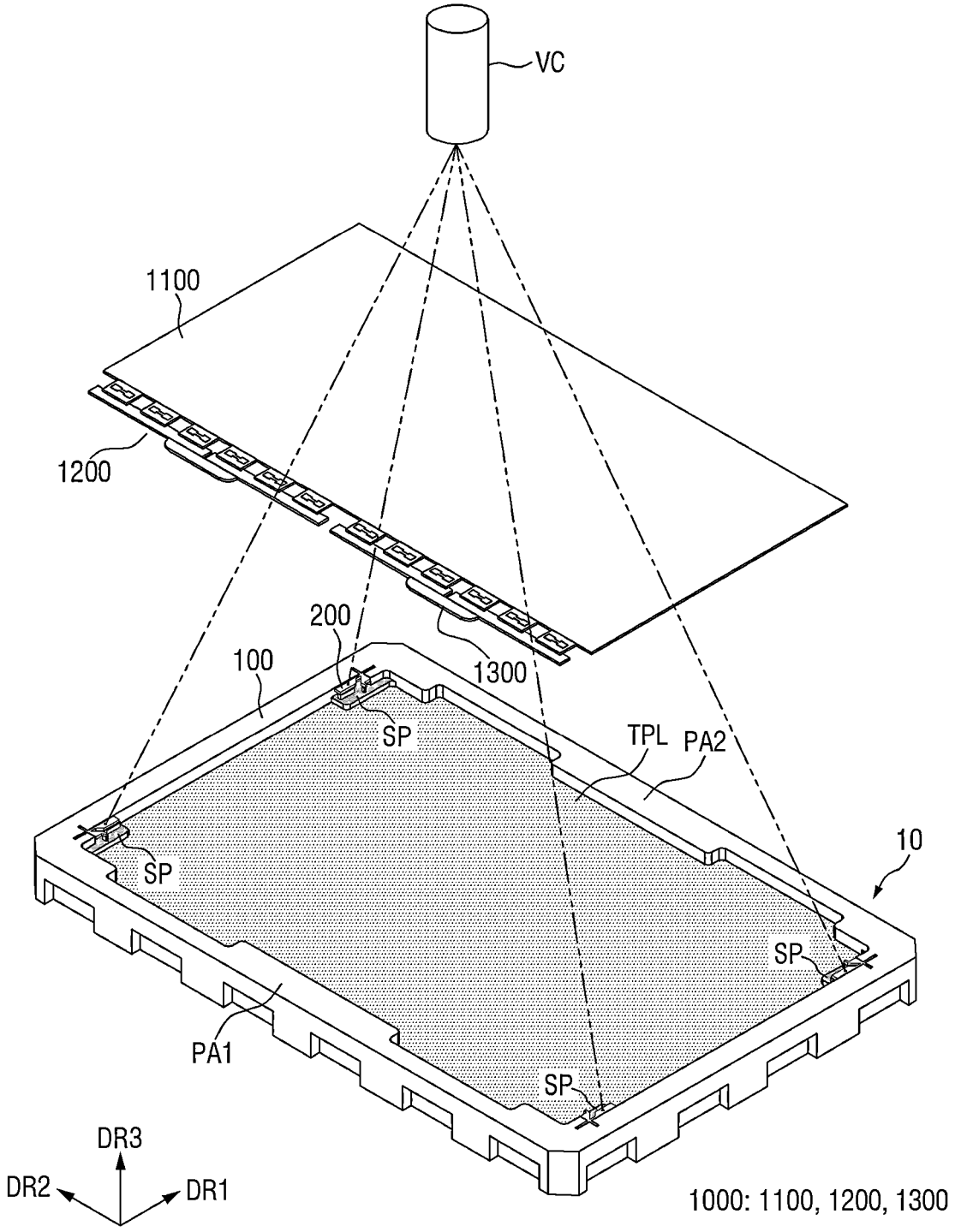

Next, referring to FIGS. 14 and 15, the panel 1000 is disposed on the panel tray 10, and the panel 1000 and the panel tray 10 are aligned with each other (S200 in FIG. 12). An area of the panel 1000 in a plan view may be smaller than that of a space surrounded by the main body part 100 of the panel tray 10 or a space in which the panel 1000 is mounted. If the panel 1000 and the panel tray 10 are not aligned with each other, the panel 1000 may be damaged by an external impact in a process of seating the panel 1000 in the panel tray 10. In such an embodiment, precise alignment between the panel 1000 and the panel tray 10 may be desired to seat the panel 1000 in a region formed by the guide parts 210 and 220 of the slots 200.

According to an embodiment, the aligning of the panel tray 10 and the panel 1000 with each other may include recognizing positions of the alignment marks AM of the panel tray 10 using a camera device VC, and recognizing alignment patterns (not illustrated) defined or formed on the panel 1000 and aligning the panel 1000 and the panel tray 10 with each other on the basis of the positions of the alignment marks AM. As described above, the panel 1000 may be seated in the region formed by the guide parts 210 and 220 of the slots 200 of the panel tray 10. Accordingly, the panel 1000 may be aligned to be positioned within the region formed by the guide parts 210 and 220 of the slots 200. In an embodiment, for example, the panel 1000 may be aligned so that both sides and corners of the display panel 1100 are positioned inside the guide parts 210 and 220 of the slots 200.

According to an embodiment, the aligning of the panel tray 10 and the panel 1000 with each other may include recognizing positions of the alignment marks AM of the panel tray 10 and recognizing the alignment patterns included in the panel 1000 by the camera device VC and aligning the panel 1000 so that the panel 1000 is positioned inside the guide parts 210 and 220 of the slots 200 based on the positions of the alignment marks AM. Substantially, the panel 1000 is desired to be aligned to be positioned inside a region formed by the slots 200, more specifically, the region formed by the guide parts 210 and 220 of the slots 200. Before a position of the panel 1000 is determined, positions of the slots 200 may be recognized. According to an embodiment, the positions of the slots 200 may be recognized through a process of recognizing the positions of the alignment marks AM of the slots 200.

Figure 16:
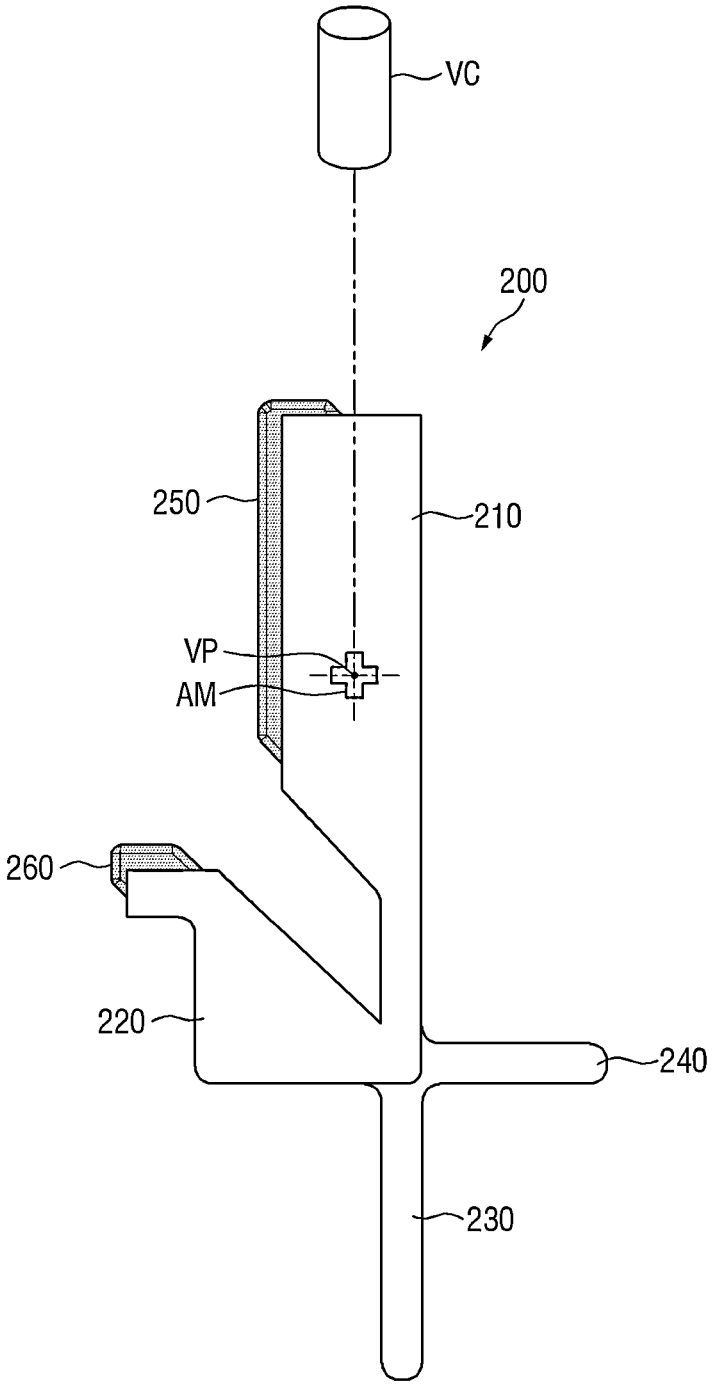

Referring to FIG. 16, the camera device VC may recognize a position of a specific member through a recognition point VP. The camera device VC may set the recognition point VP in a region in which the alignment mark AM is disposed in the slot 200 of the panel tray 10 to recognize the position of the alignment mark AM, and recognize the position of the slot 200 from the position of the alignment mark AM. Since the camera device VC sets the recognition point VP at the alignment mark AM of the slot 200, a misrecognition rate may be lower than that a case where the recognition point VP is set at other parts of the slot 200, for example, the guide parts 210 and 220, and the fastening parts 230 and 240, or a central portion of the slot 200. In an embodiment, as described above, the alignment mark AM formed in the slot 200 is clearly distinguished from the surrounding region based on the shape, color, surface roughness, or the like, and thus, a misrecognition rate by the camera device VC may be low.

The camera device VC may recognize the position of the panel 1000 through the alignment pattern (not illustrated) formed on the panel 1000, similar to recognizing the position of the panel tray 10 or the slot 200 through the alignment mark AM. When the positions of the alignment marks AM and the positions of the alignment patterns are recognized by the camera device VC, the positions of the alignment marks AM and the positions of the alignment patterns may be compared with each other, and the panel 1000 may be aligned to be positioned inside the guide parts 210 and 220 of the slots 200.

In such a process, a direction in which the external devices 1200 and 1300 of the panel 1000 are positioned may be set. The panel tray 10 may include protrusion parts PA1 and PA2 formed in the main body part 100, and a direction that the external devices 1200 and 1300 of the panel 1000 face may be determined according to positions of the protrusion parts PA1 and PA2. In the recognizing of the positions of the alignment marks AM and the positions of the alignment patterns of the panel 1000 by the camera device VC and the aligning of the panel, the panel 1000 may be aligned so that the external devices 1200 and 1300 face a direction in which the protrusion parts PA1 and PA2 of the main body part 100 are positioned.

Figure 17:
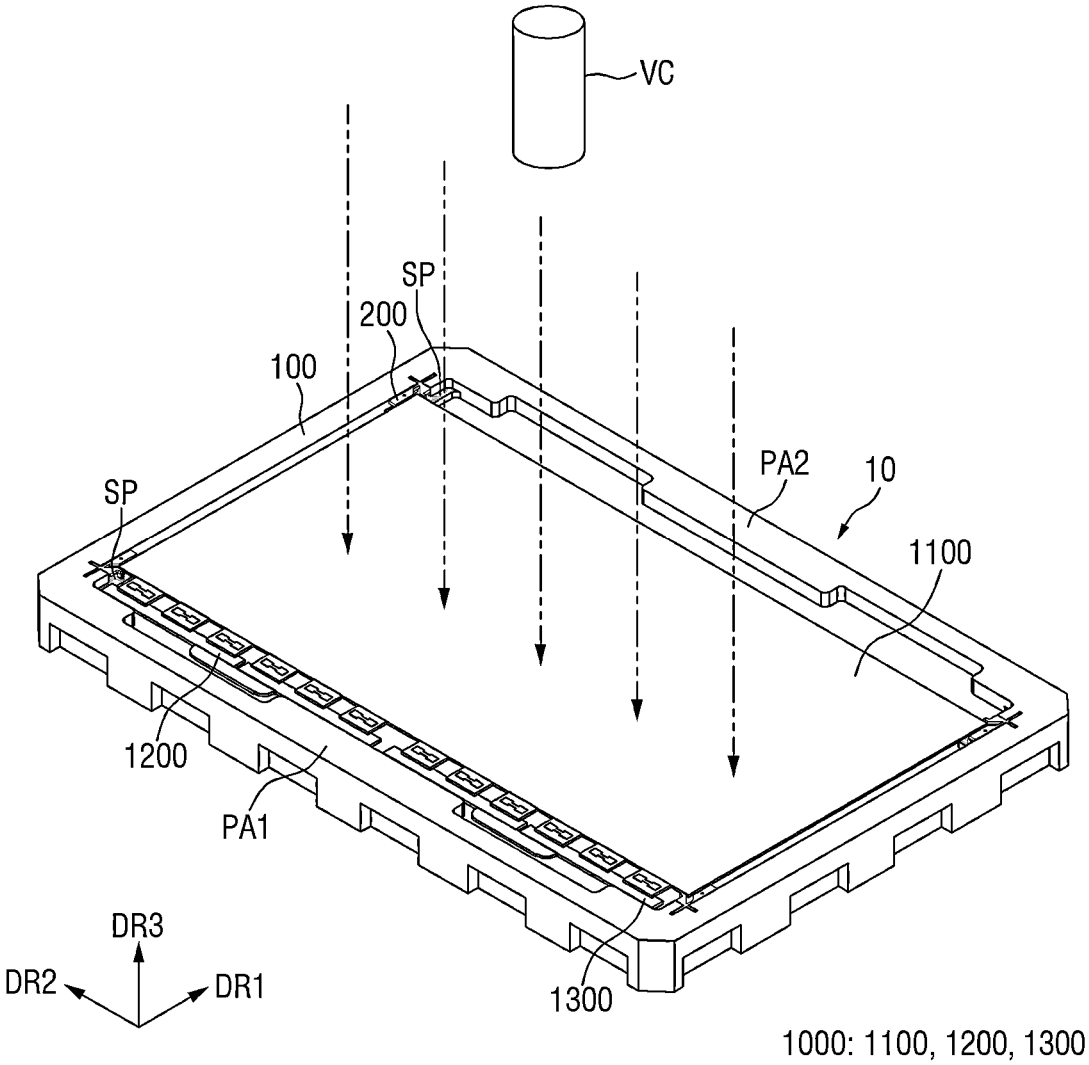

Next, referring to FIG. 17, the panel 1000 may be seated and packaged in the panel tray 10 (S300 in FIG. 12). When the panel tray 10 and the panel 1000 are completely aligned with each other, for example, when the panel 1000 is positioned inside the guide parts 210 and 220 of the slots 200, the panel 1000 is seated in the panel tray 10. Since the panel 1000 is positioned in the region formed by the guide parts 210 and 220 of the slots 200, the panel 1000 may not be in contact with the slots 200 and may be seated on the support parts SP of the main body part 100. The alignment between the panel 1000 and the panel tray 10 is accurate and a misalignment rate between the panel 1000 and the panel tray 10 is decreased, such that damage to the panel 1000, particularly the display panel 1100, may be prevented in a process of seating the panel 1000.

Figure 18:
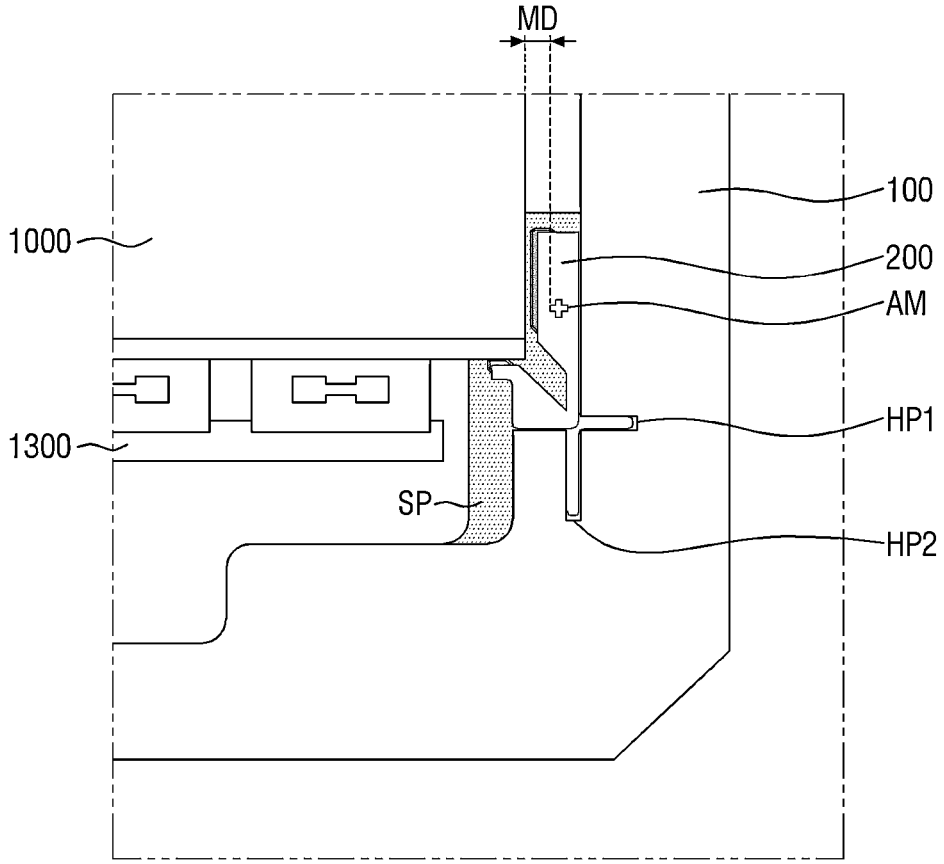
FIG. 18 is a plan view illustrating a portion of the panel packaged in the panel tray according to an embodiment.

FIG. 18 is a plan view illustrating a portion of the panel packaged in the panel tray according to an embodiment.

Referring to FIG. 18, when the panel 1000 is seated in the panel tray 10, sides of the display panel 1100 of the panel 1000 may be disposed to face the guide parts 210 and 220 of the slots 200. Sides of the display panel 1100 extending in the first direction DR1 may face the first guide parts 210 of the slots 200, and sides of the display panel 1100 extending in the second direction DR2 may face the second guide parts 220 of the slots 200. In an embodiment, the sides of the panel 1000 may be spaced apart from the guide parts 210 and 220. In an embodiment, for example, an interval between the panel 1000 and the guide parts 210 and 220 of the slot 200 spaced apart from each other may be in a range of 4 mm to 8 mm. In an embodiment, in a process of seating the panel 1000 in the panel tray 10, an interval MD between an outer side of the panel 1000 and the alignment mark AM may be in a range of about 4 millimeters (mm) to about 8 mm. When the panel 1000 and the slot 200 are spaced apart from each other within the above range, damage to the panel 1000 may be minimized even though the panel 1000 moves in the panel tray 10 and comes into contact with the slot 200.

However, the disclosure is not limited thereto. In an alternative embodiment, the panel 1000 may be disposed to be in contact with the guide parts 210 and 220 or to be in contact with the cushion parts 250 and 260 of the slot 200 as illustrated in FIG. 18. Even though the panel 1000 is mounted to be in contact with the cushion parts 250 and 260, the cushion parts 250 and 260 may absorb an external impact to prevent damage to the panel 1000.

According to an embodiment, the panel tray 10 includes the plurality of slots 200 disposed at each corner, and each of the slots 200 includes the alignment mark AM. An embodiment of a method of packaging a panel 1000 in the panel tray 10 may decrease the misalignment rate between the panel 1000 and the panel tray 10 and prevent the panel 1000 from being damaged in a process of packaging the panel because the panel tray 10 and the panel 1000 are aligned with each other based on the alignment marks AM of the slots 200.

The invention should not be construed as being limited to the embodiments set forth herein. Rather, these embodiments are provided so that this disclosure will be thorough and complete and will fully convey the concept of the invention to those skilled in the art.

While the invention has been particularly shown and described with reference to embodiments thereof, it will be understood by those of ordinary skill in the art that various changes in form and details may be made therein without departing from the spirit or scope of the invention as defined by the following claims.

What is claimed is:

1. A method of packaging a panel, the method comprising:

preparing a panel tray including a main body part including a plurality of outer walls defining a space in which the panel is mounted, and a plurality of slot members disposed respectively at corners of the main body part, wherein the slot members include a plurality of alignment marks defined on upper surfaces thereof;

aligning the panel on the panel tray; and seating the panel in the space of the main body part, wherein each of the slot members includes a first guide part parallel to one sidewall of the outer walls extending in one direction and a second guide part parallel to another sidewall of the outer walls extending in another direction intersecting the one direction, and each of the alignment marks is defined on an upper surface of one of the first guide part and the second guide part.

2. The method of claim 1, wherein the aligning the panel on the panel tray includes:

recognizing positions of the alignment marks of the panel tray; and recognizing a plurality of alignment patterns defined on the panel and aligning the panel tray and the panel with each other based on the positions of the alignment marks.

3. The method of claim 2, wherein each of the alignment marks is defined on a same guide part among the first guide part and the second guide part of each of the slot members.

4. The method of claim 1, wherein an interval between a side of the panel and a corresponding one of the alignment marks is in a range of about 4 mm to about 8 mm when the panel is seated in the space of the main body part.

5. The method of claim 4, wherein the panel is disposed in a region defined by the first guide part and the second guide part of each of the slot members.

6. The method of claim 4, wherein the side of the panel is spaced apart from and face the first guide part and the second guide part of a corresponding one of the slot members.

7. The method of claim 1, wherein the main body part includes a plurality of groove parts defined at the corners of the outer walls and defined by recessed portions of the outer walls, the plurality of groove parts including a first groove part and a second groove part intersecting the first groove part, and each of the slot members includes a first fastening part extending in an opposite direction to the first guide part and inserted into the first groove part and a second fastening part extending in a direction intersecting the first fastening part and inserted into the second groove part.

8. The method of claim 1, wherein each of the alignment marks is defined by an engraved pattern in which a portion of the upper surface of the one of the first guide part and the second guide part is recessed, each of the alignment marks further includes ink filling the engraved pattern, and the ink has a color different from a color of the upper surface of the one of the first guide part and the second guide part.

9. The method of claim 1, wherein each of the slot members includes about 30 parts by weight to about 45 parts by weight of fibers based on 100 parts by weight of polyurethane, and a portion of the upper surfaces of the one of the first guide part and the second guide part except for a region in which the alignment marks are defined has a surface roughness greater than a surface roughness of an upper surface of a corresponding one of the alignment marks.

10. The method of claim 1, wherein a maximum width of each of the alignment marks is in a range of about 3 mm to about 6 mm.

* * * * *